United States Patent [19]

Ulery

[11] Patent Number: 4,797,120

[45] Date of Patent: Jan. 10, 1989

[54] COAXIAL CONNECTOR HAVING FILTERED GROUND ISOLATION MEANS

[75] Inventor: Kirk D. Ulery, Mount Joy, Pa.

[73] Assignee: AMP Incorporated, Harrisburg, Pa.

[21] Appl. No.: 132,390

[22] Filed: Dec. 15, 1987

[51] Int. Cl.[4] ..... H01R 17/04

[52] U.S. Cl. ..... 439/578

[58] Field of Search ..... 439/578–585, 439/607–610

[56] References Cited

U.S. PATENT DOCUMENTS

| | | | |
|---|---|---|---|
| 3,283,287 | 11/1966 | Stark et al. | 339/177 |
| 4,165,911 | 8/1979 | Laudig | 339/89 |
| 4,206,963 | 6/1980 | English et al. | 339/147 |
| 4,215,326 | 7/1980 | Hollyday | 339/143 |
| 4,265,506 | 5/1981 | Hollyday | 339/147 |
| 4,672,342 | 6/1987 | Gartzke | 439/578 |
| 4,708,666 | 11/1987 | Fisher, Jr. | 439/578 |

OTHER PUBLICATIONS

AMP Inc. Handbook, HB 5013, Rev. C, 1976.

AMP Inc. Guide to RF Connectors, Catalog 80–570, 7/82, pp. 156–168.

*Primary Examiner*—Joseph H. McGlynn

*Attorney, Agent, or Firm*—Katherine A. Nelson

[57] ABSTRACT

A filtered electrical device 38 for being secured externally to an electrical connector and electrically engagable to at least one circuit path thereof comprises at least one contact member 40, a housing member 56 having at least one filter receiving aperture 60 therein, filter member 68 disposed in the at least one aperture 60 and electrically connected to said at least one contact member 40 and a ground means. Contact member 40 has first and second contact portions 42, 46, the first contact portion 42 being secured in the housing 56 and engagable with the at least one circuit path of the electrical connector to which the filtering device 38 is secured. Second contact portion 46 is exposed along a bottom surface 62 of aperture 60 and is paired with and spaced from third contact portion 50 which is also exposed along a bottom aperture surface 62. Fourth contact section 52, engagable with ground means is secured in housing 56 and extends outwardly from third contact section 50. Filter member 68 is electrically engaged to the pairs of second and third contact portions 42, 46. The invention is further directed to a coaxial connector having device 38 mounted thereon to provide filtering means between the connector and an isolated ground means.

20 Claims, 6 Drawing Sheets

COAXIAL CONNECTOR HAVING FILTERED GROUND ISOLATION MEANS

FIELD OF THE INVENTION

This invention relates to electrical connectors and more particularly to coaxial connectors having means for providing protection against electromagnetic and radio frequency interference in data communication systems.

BACKGROUND OF THE INVENTION

Electrical circuitry often must be protected from disruptions caused by electromagnetic interference (EMI) and radio frequency interference (RFI) entering the system.

In addition to protecting electronic equipment against EMI/RFI energy, there is also a need to protect the equipment against power surges owing to electrostatic discharges (ESD) and electromagnetic pulse (EMP). The high voltage generated by ESD and EMP can damage voltage sensitive integrated circuits and the like.

The present invention relates to data transmission systems for transmitting information between a master unit and one or more remote units of a subordinated system or between subordinated terminal units in systems known generally as local area network or wide area network systems. In interconnecting equipment in such systems it is necessary to both transmit and receive information from other members in the system. Generally, these systems use a coaxial connector comprised of an inner signal line and an outer shield member to filter interference from the line. Both the sending and receiving signal lines are interconnected by such coaxial connectors. This requires a plurality of coaxial transmission lines be established between various units within the system.

With the wide use of such systems, it is desirable to have a more cost effective system wherein one coaxial connector transmission line can be used as both the sending and receiving line. In such a system, the shield of the coaxial connector is used as a return line instead of a shield for the outgoing signal. The return line then is now an unshielded signal line and must be filtered to prevent spurious signals from entering the electronic equipment. It is necessary, therefore, to isolate the ground system of the equipment from the shield, now signal line, of the coaxial connector.

Generally, the isolation between the connector and ground is accomplished by the use of isolation bushings, one placed between the connector and the back panel of the equipment, and the second placed between the back panel and the mounting means used to mount the connector to the back panel of the equipment. Filtering between the connector and ground has been accomplished by the use of leaded capacitive devices connected between the outer shell of the coaxial connector and the ground system of the electronic unit such as a terminal, thus isolating AC current from the DC signal line and transmitting the AC current to ground. Since leaded devices have an extra impedance associated with the leads it is desirable to have a means for isolating the AC current that uses unleaded devices.

In many instances it is desirable to have an external filtering device that is an "add-on" device to provide filtering to an already existing non-filtered connector. This is particularly desirable in instances when the same basic connector may be used in a number of different applications, each having different filtering requirements. It is also desirable that a method of making the devices be found to that will lend itself to automation of the assembly line by robotic devices and the like that will enable filtered connectors to be manufactured in a more cost effective manner.

SUMMARY OF THE INVENTION

In accordance with the present invention, an electrical component is provided which can be secured to an electrical article such as an electrical connector, the component being engageable to at least one circuit path of the article to providing filtering for the selected circuit path or paths. The electrical component is comprised of a dielectric housing member having at least one contact member secured therein and housing at least one filter receiving aperture along a first face thereof. The at least one contact member has first and second contact portions, the first contact portion being engageable with the at least one circuit path of the article. The second contact portion is exposed along a bottom surface of the filter receiving aperture of the housing member. A third contact portion, paired with the second contact portion and spaced therefrom, is exposed along the bottom aperture surfaces of the housing member. The component further includes a fourth contact portion, which extends outwardly from the third contact portion, the fourth contact portion being adapted to be engaged by grounding means. A filter member is disposed in the at least one filter receiving aperture and is electrically joined to the pair of second and third contact portions.

The electrical component of the invention is connected to an associated electrical articles by electrically engaging the first contact portions to at least one circuit path of the electrical article and the fourth contact portion to a grounding means for the article. In the preferred embodiment of this invention, the component as described above is formed as part of one side of an isolation bushing used with coaxial connector as previously described. The component is secured to the bushing such that the first contact portion of the component is electrically connected to the shield or return line of the coaxial connector and the fourth contact portion is wrapped around the bushing to engage the back panel of the equipment to which the connector is mounted.

It is an object of the present invention to provide electrical filtering means that can be externally mounted to an electrical connector or other electrical article.

It is another article of the invention to provide a filtering device that can be added on to an existing unfiltered connector.

It is a further object of the invention to provide an external filtering device that lends itself to automated assembly procedures.

It is another object of the invention to provide a filtering device which can be manufactured in a continuous strip.

Another object of the invention is to provide a method for manufacturing a filter device that may be used to retrofit existing connectors.

Furthermore, it is an object of the invention to provide a filtering device for coaxial connectors wherein the outer conductor of the coaxial connector must be isolated from the system or equipment ground.

The invention itself, together with further objects and its attendant advantages, will be best understood by reference to the following detailed description, taken in conjunction with the accompanying drawings.

DETAILED DESCRIPTION OF THE DRAWINGS

Figure 1:
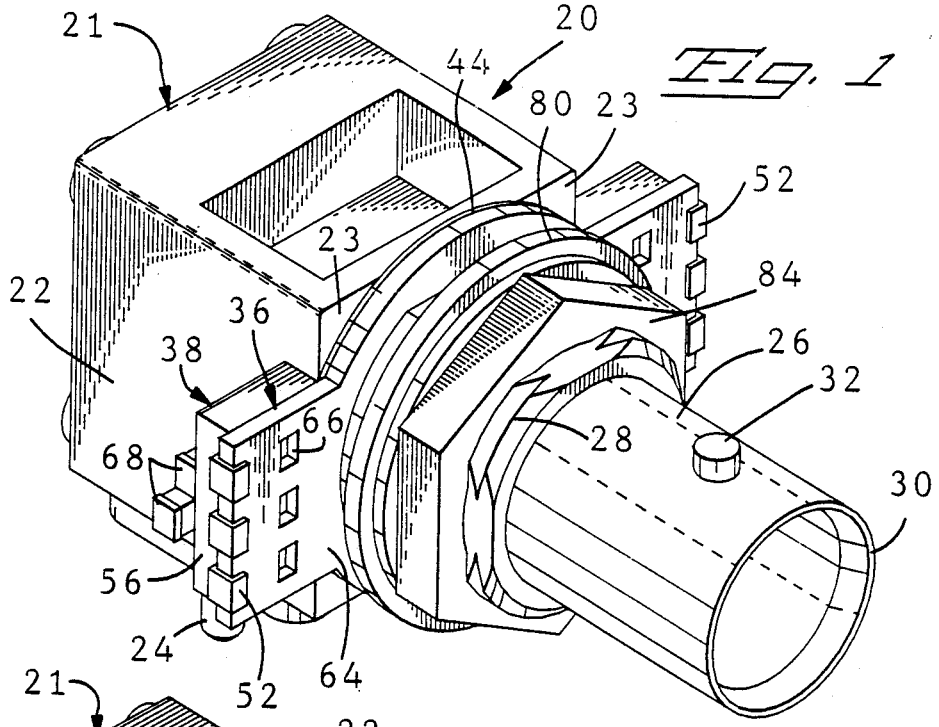
FIG. 1 is a perspective view of the electrical connector assembly of the present invention.
Figure 2:
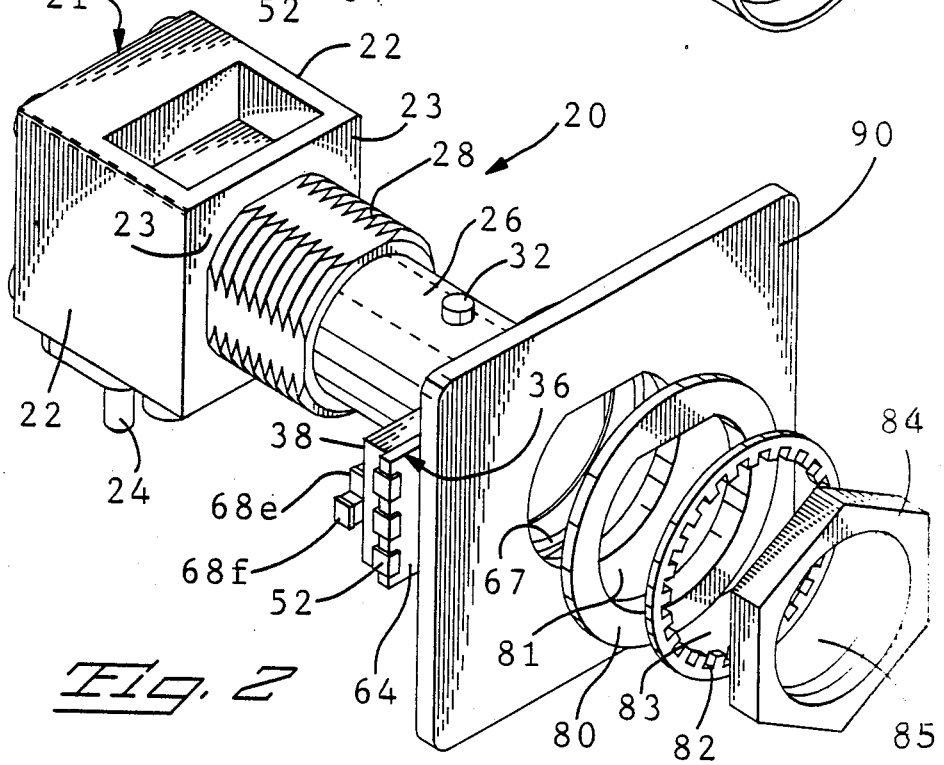
FIG. 2 is a perspective view of the electrical connector of FIG. 1 mounted to a back panel with the parts exploded therefrom.
Figure 3:
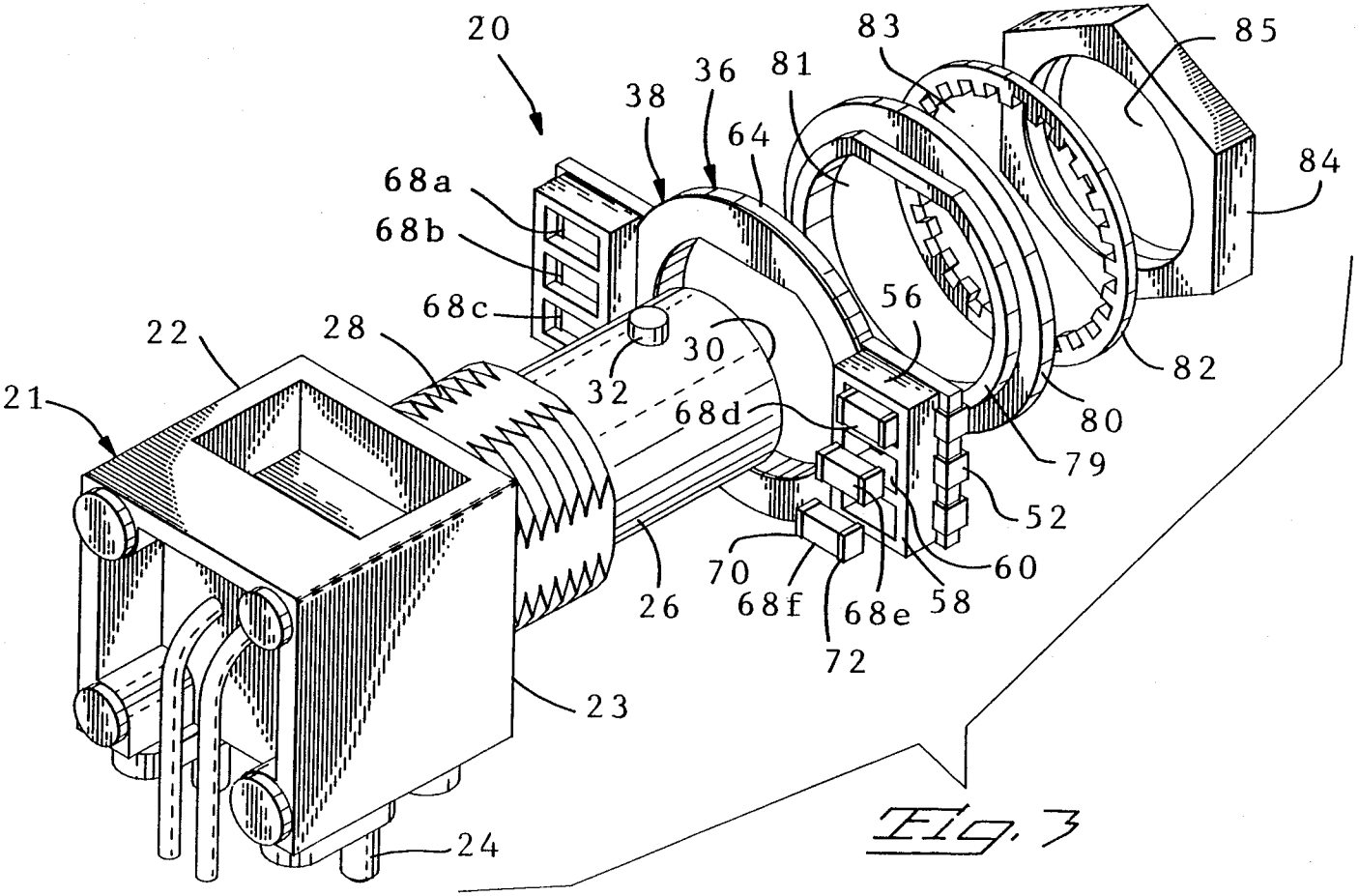
FIG. 3 is a view similar to that of FIG. 2 with the assembly rotated 180° and the back panel removed for purposes of clarity.

Referring now to FIGS. 1 through 3. The connector assembly 20 is comprised of a coaxial connector 21 having a filtering device 36 mounted thereto for isolating spurious signals between connector 21 and an isolated ground panel 90. Connector 21, which is illustrated in these Figures, is a coaxial connector having a bayonet coupling and is known in the art as a BNC connector. It is to be understood that this connector is for illustrative purposes only and that other types of coaxial connectors may also be used in accordance with this invention. Connector 21 is comprised of a conductive outer body having first and second portions, the first being a rectangular block portion 22 and the second being a cylindrical portion 26 extending outwardly therefrom and an internal which forms the shield or outer conductor of the connector and an inner conductor (not shown). Cylindrical portion 26 further has external threads 28 thereon for securing mounting means thereto when connector 21 is mounted to a back panel 90 or the like. Cylindrical portion 26 further has radial projecting prongs 32 known as bayonet couplings at a forward end thereof. Connector assembly 20 further includes dielectric isolation means comprising first isolation bushing member 64 and second isolation bushing member 80, washer 82 and nut 84. As is best seen in FIGS. 2 and 3, filter device 36 is mounted to first bushing member 64 having aperture 65 therein dimensioned to be received by cylindrical portion 26 so that filter assembly 36 lies against wall 23 of body portion 22 in the assembled device. Second isolation bushing member 80, washer 82, and nut 84 have apertures 81, 83, and 85 therein for being received over the conductive cylindrical portion 26 and threaded portion 28 with nut 84 being securable to threaded portion 28.

Figures 4, 4A:
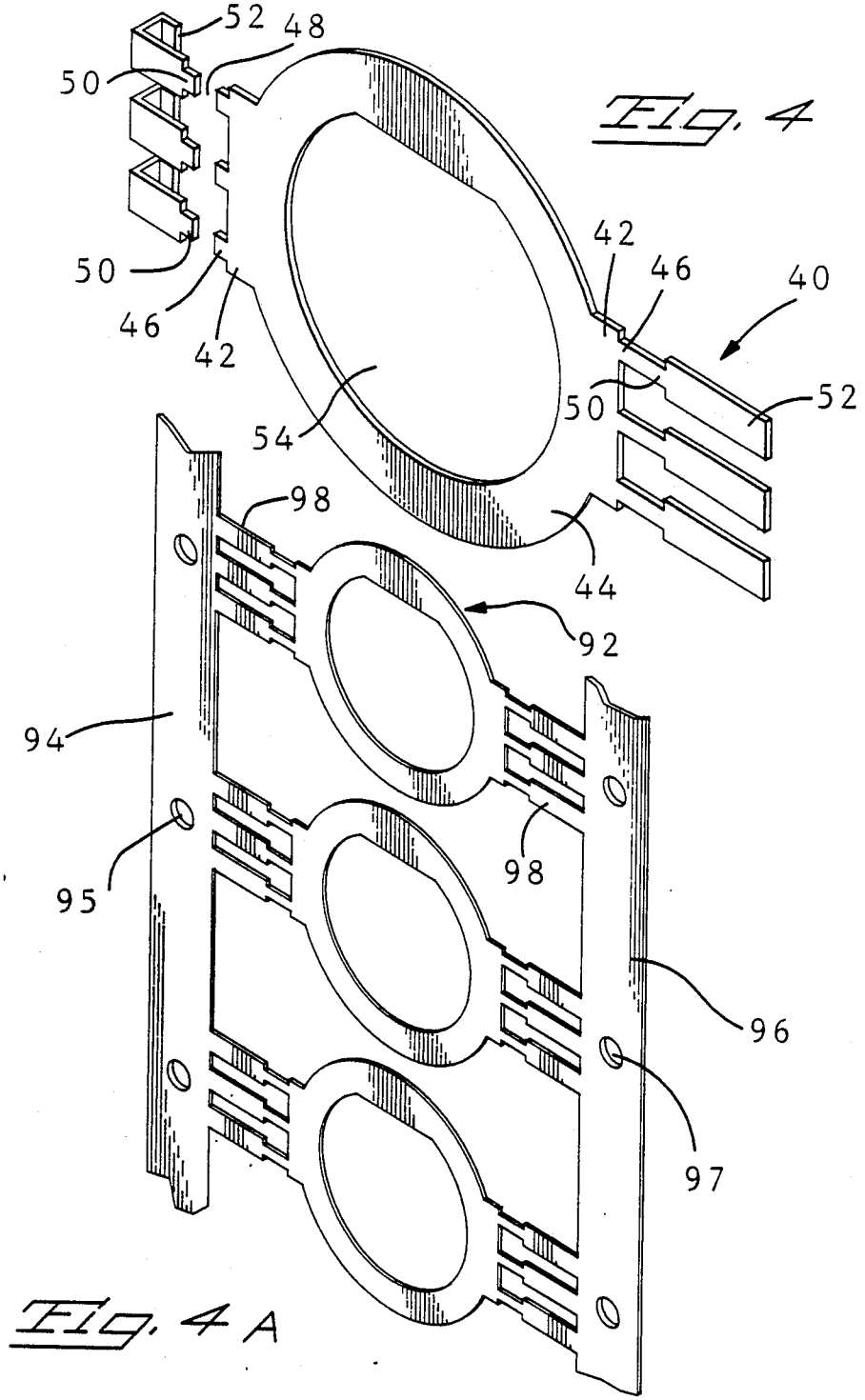
FIG. 4 is a plan view of one of the lead frames illustrating the sequence of steps in forming the device of the present invention.
FIG. 4A is a plan view of a strip of lead frames used in forming the device of the present invention.
Figure 5:
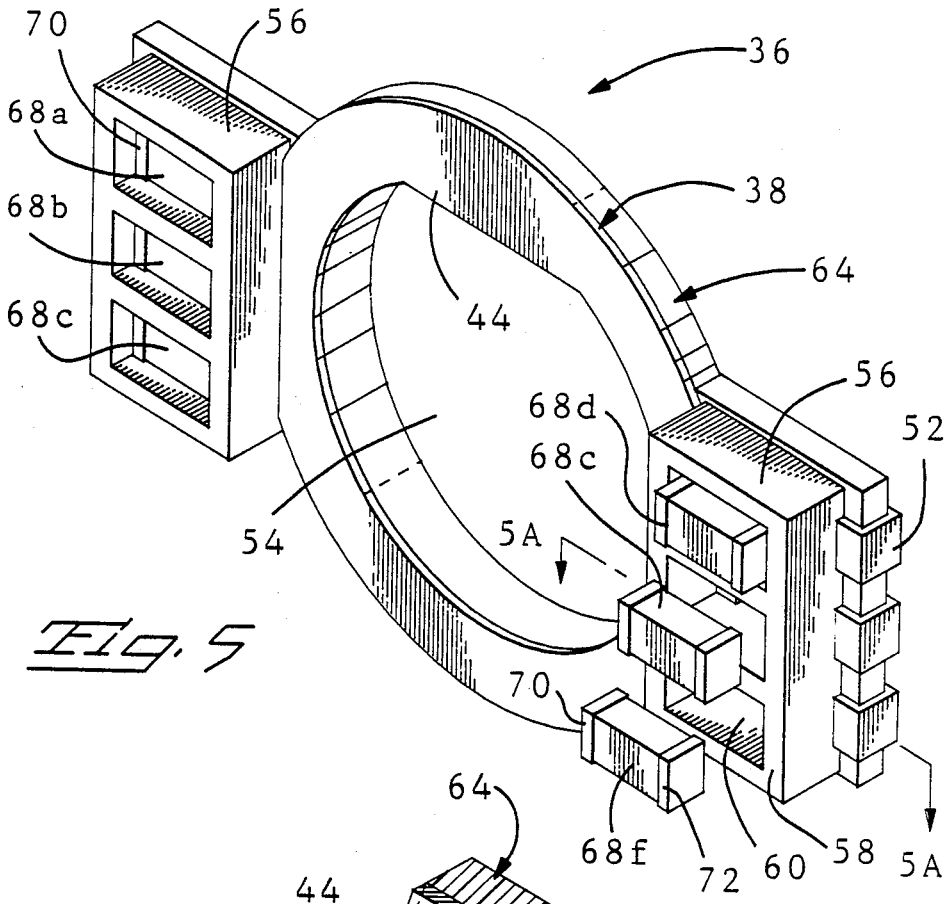
FIG. 5 is a perspective view of the device mounted to the isolation bushing.
Figure 5A:
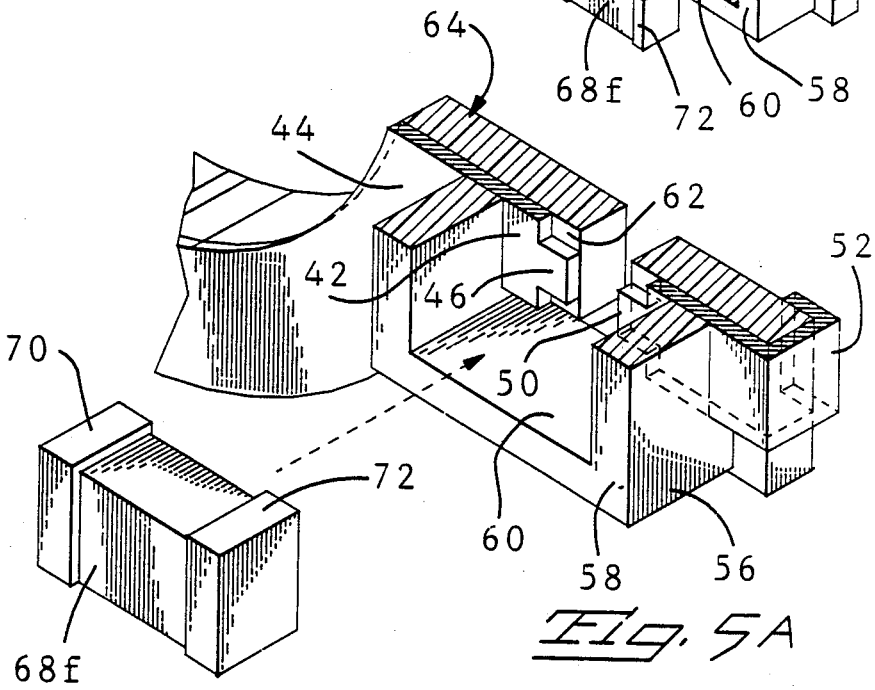
FIG. 5A is a cross-sectional view of taken along 5A, 5A of FIG. 5.
Figure 6:
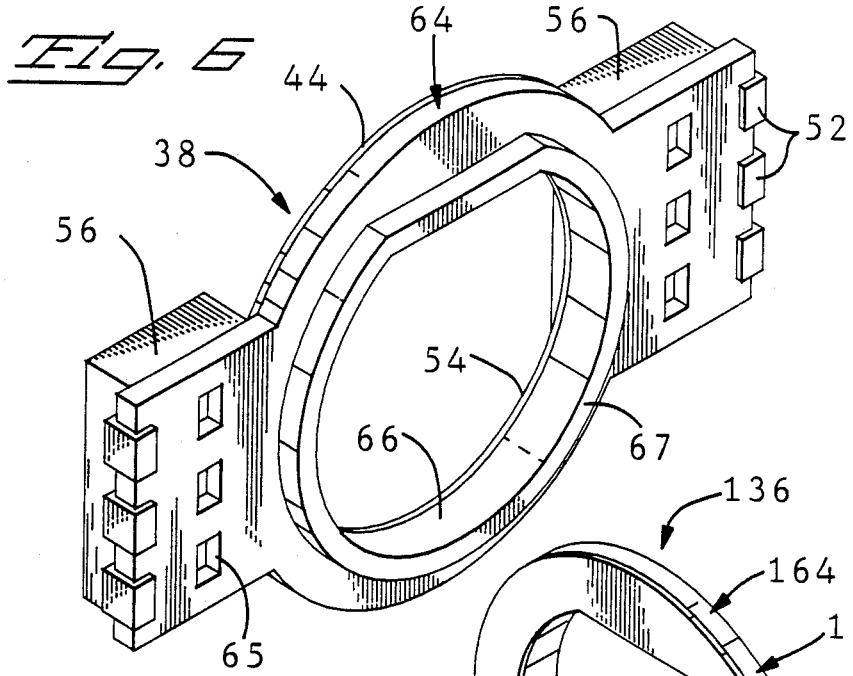
FIG. 6 is a perspective view of the underside of the device of FIG. 5.

Referring now to FIGS. 4 through 6, a filtering device 38 is designed to be used with an electrical article to provide filtering for selected circuit paths of the articles. Device or component 38 is comprised of a plurality of contact members 40, a dielectric housing member 56 and filter members generally numbered 68. Six filter members 68*a–f* are used as seen in FIG. 5. Contact members 40 have first and second contact portions 42 and 46 respectively. First contact portions 42 are engageable with corresponding contact portions of an electrical article. First contact portions 42 are secured in the housing member 56. Dielectric housing member 56 includes a plurality of filter receiving apertures 60 along a first face 58 thereof as best seen in FIG. 5A. Second contact portions 46 are exposed along a bottom surface 62 of respective apertures 60. Third contact portions 50 paired with second contact portions 46 and are spaced therefrom at 48. Third contact portions 50 are also exposed along the bottom surface 62 of respective filter receiving apertures 60. Fourth contact portions 52 are secured in housing member 56, said fourth contact portions 52 extending outwardly from the third contact portion 50 and being adapted to be engaged by grounding means. A plurality of filter members 68 are disposed in respective filter receiving apertures 60 of housing member 56 and electrically joined to respective pairs of second contact portions 46 and third contact portions 50. The filter members 68 are surface mounted components having a dielectric body with first and second conductive portions or contact means 70, 72 thereon for mounting to pairs of second and third contact portions 46 and 50. The numbers of filter members used will depend upon the desired amount of capacitance or other electrical properties desired in the connector. Filter members 68 are surface mounted components such as chip capacitors, resistors, uni- or bipolar diodes or the like. First contact portions 42 further has connecting means 44 for electrically connecting first contact portion 42 to conductive shell of connector 21. In the embodiment shown, connecting means 44 is a ring member having aperture 45 therein for receiving cylindrical portion 26 and threaded portion 28 of connector 21 therethrough. In the assembled connector, ring member 44 lines against wall 23 of block portion 22.

In the preferred embodiment, first isolation bushing member 64 is formed concomitantly with the dielectric housing member 56 to form a single unit. Bushing member 64 has aperture 65 therein for receiving or dimensioned to be mounted over connector barrel portion 26 in the same manner as previously described. Bushing member 64 further has aperture 66 therein as best seen in FIG. 6, which is in alignment with the space 48 between second and third paired contact portions 46, 50, respectively.

Electrical device 38 is made in the same manner as the electrical device described in U.S. patent Ser. No. 07/098/725, the disclosure of which is incorporated herein by reference. The formation of electrical device 38 therefore will be summarized in general terms.

As illustrated in FIG. 4, electrical device 38 preferably is made in continuous form by stamping and forming a plurality of lead frames 92 in a strip of suitable flat stock metal such as copper, phosbronze, or the like as known in the art. The strip is first stamped to form first and second carrier strips 94, 96 having a plurality of essentially parallel cross bar members or contact means 82 extending from carrier strip 94 to ring member 44 and from ring member 44 to carrier strip 78. as is shown in FIG. 4A. Cross bar member 94 become contact member sections 40, 46, 50 and 52 in the assembled device. Carrier strips 94, 96 have apertures 95 and 97 therein which are used for aligning the strip in the manufacturing and assembly process. If desired cross bar members 98 may be plated on the desired contact area.

Housing members 56 and isolating bushing members 64, are the insert molded around portions of the stamped members, each housing encompassing the desired number of cross-bar members. A plurality of filter receiving apertures 60 are also formed, one aperture 60 being associated with each cross member 82 within housing 56. The material used for molding the housings is preferable one that will withstand the temperatures associated with vapor flow soldering techniques. One preferred material is polyphenylene sulfide, available from Phillips Petroleum Co. under the trade name Ryton®. Other suitable materials are known in the art.

FIG. 4 shows the structure of the metal portion during various stages of the assembly. When the member is first formed, cross-bar members 98 extend between those portions which will become second and third contact portions 46, 50, respectively. After the housing members and bushings are formed, a portion of the cross-bar members 98 is removed at 28 to form the contact portions of device 38. Concomitantly, a portion of the underlying dielectric housing material and bushing material is also removed to form cavity 66 in the bushing member as best seen from the back view in FIG. 6. After devices 38 have been removed from the frame, fourth contact portion 52 is formed around the edge of bushing member 64 and lies on the undersurface thereof. Lastly, filter members 68*a–f* are mounted and preferably soldered in their respective apertures.

As can be appreciated, filter devices 38 can be formed on the strip while remaining attached to carrier strips 94 and 96. At that stage, they may be rolled onto a reel (not shown) until device 38 is ready to be assembled to an article. At that time, individual devices 38 may be severed and fourth contact portions 52 formed around edge of bushing member 64.

The process for making device 38 lends itself to automation since the metal strip may be stamped and formed, rolled on a reel (not shown), and later formed into electrical devices 38 in accordance with the invention. Once housing members 56 and bushing members 64 have been molded, the strip is moved to a stamping station to stamp and form the device of the desired configuration. Insertion of the filter members 68 lends itself to pick and place robotic system. The well defined apertures 60 can be aligned so that the equipment can place filter members 68 between the second and third contact portions 46 and 50 at selected locations.

Figure 7A:
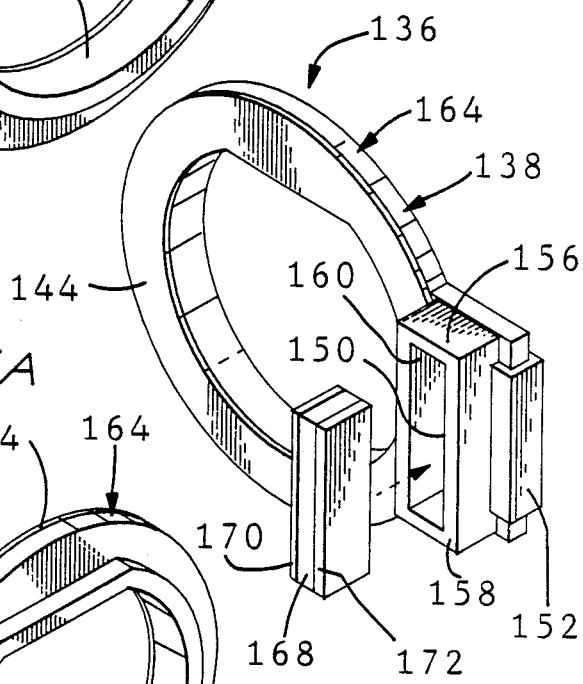
FIG. 7A is a perspective view illustrating an alternative embodiment of the device of the present invention.
Figure 7B:
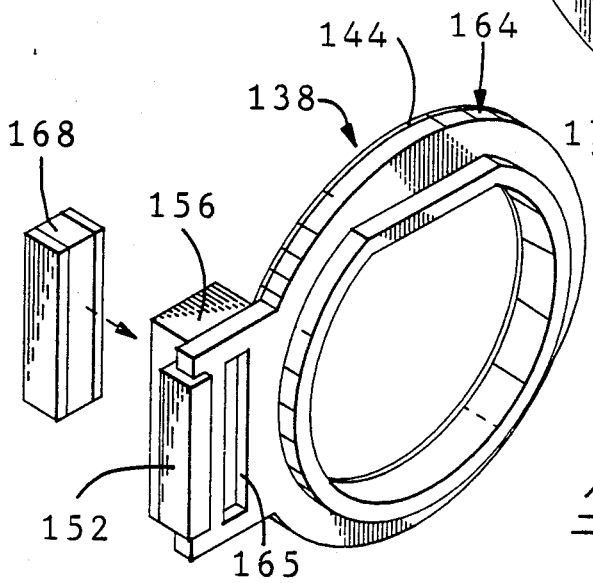
FIG. 7B shows the underside of the device of FIG. 7A.

FIGS. 7A and 7B illustrate a further embodiment 138 of the filtering device wherein the housing member 156 has one filter receiving aperture 160 therein for receiving filter member 168. Filter member 168 is preferably a capacitor having first and second contact means or conductive portions 170, 172 thereon. The single capacitor or electrical component has the same filtering capabilities as a plurality of capacitors shown in the previous embodiment. In this embodiment, there is only one first contact portion (not shown) on ring member 144 with one fourth connector portion 152 wrapping around bushing member 164. FIG. 7B shows the single aperture 165 formed on the undersurface of bushing member 164.

Figure 8A:
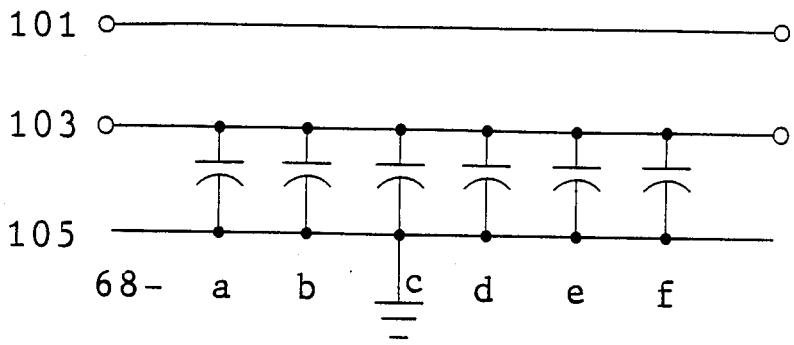
FIGS. 8A, B, and C are electrical schematic diagrams of the present invention.
Figure 8B:
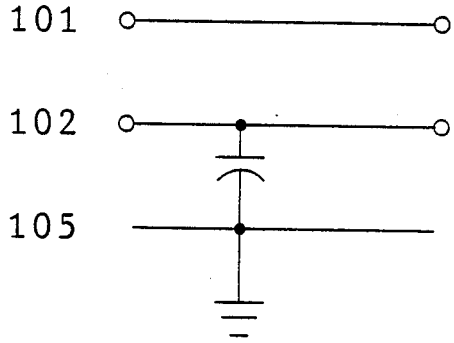
Figure 8C:
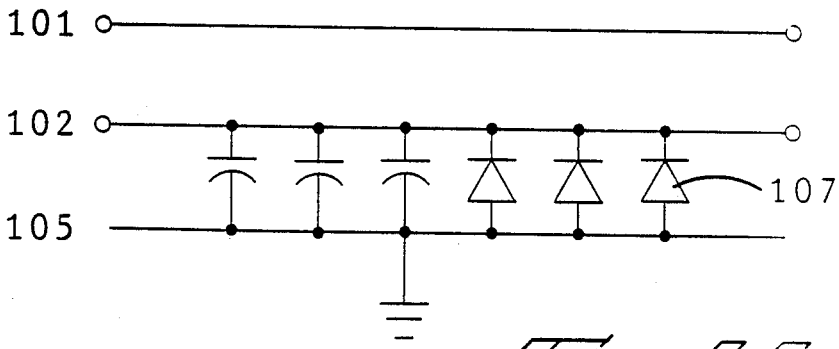

FIG. 8 shows the electrical schematic drawing of the embodiment disclosed in this application. FIG. 7A is a schematic drawing for the embodiment shown in FIG. 5 wherein the connector has inner conductor 101, outer conductor 103 and the ground conductor is represented as 105. FIG. 8A shows six capacitive elements in parallel between inner conductor 103 and ground 105. FIG. 8B shows the schematic drawing for the alternative embodiment shown in FIG. 7 wherein one capacitor takes the place of six smaller capacitors. FIG. 8C shows a further alternative embodiment wherein one or more of the capacitive elements shown in FIG. 5 is replaced by a blocking diode 107.

It is to be understood that the electrical connectors used with the present device are representative samples only. It is to be further understood that frame and shape and types of connectors with which this device may be used are numerous. By filtering electrical connectors with an externally mounted filtering device, it is possible to selectively filter lines by omitting filter members from the various apertures. This allows the same basic connector to be filtered readily, in a variety of configurations and in a cost effective manner. By making a filtered device in accordance with this manner, the filtering device lends itself to cost effective manufacturing process which includes automatic equipment such as pick and place robots. Lead frame technology and insert molding lend themselves to continued automated manufacturing process which minimize handling of the device as well as time and labor. The device uses small surface filters, capacitors, transient suppression diodes, resistors or other components that are designed to be in parallel with the circuit, between signal line and ground. The components used for any one connector need not be identical and selected frequencies may be controlled by placing filter devices of varying capabilities at selected locations.

It is thought that the filter device of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

I claim:

1. An electrical coaxial connector assembly having filtered isolation means for isolating the connector from ground comprising:

a coaxial connector having a conductive inner contact and a conductive outer shell, said shell having first and second portions, said second portion extending outwardly from said first portion, said second portion including means for being mounted to a conductive panel member;

isolation means having first and second dielectric members cooperating with each other to provide a dielectric passageway through a cutout of a panel member to which the coaxial connector is to be mounted, each said dielectric member having an aperture extending therethrough for receiving said second portion of said conductive shell, said first and second dielectric members including bushing sections extending from surfaces proximate said panel member to engage and thereby form said passageway through said panel member cutout, said first and second dielectric members further including peripheral flanges to extend along major surfaces of said panel member about the periphery of said cutout;

said first dielectric member further including at least one laterally extending flange section providing a respective substrate to which at least one electrical component is mountable, conductive circuit means secured to a surface of said peripheral flange and said at least one lateral flange section, said flange surface being remote from said panel member, said circuit means including a portion substantially surrounding said aperture and adapted to engage said conductive shell of said coaxial connector and establish an electrical connection therewith; and at least one electrical component mounted to said first dielectric member including at least a first contact means connected to said conductive circuit means and including a second contact means adapted to be electrically connected with said conductive panel member whereby said at least one electrical component completes an electrical circuit and provides filtering means between said conductive shell and said conductive panel member.

2. The electrical coaxial connector assembly as described in claim 1 wherein said at least one electrical component is selected from the group consisting of chip capacitors, resistors, unipolar diodes and bipolar diodes.

3. The electrical coaxial connector assembly as described in claim 1 wherein said conductive circuit means includes first and at least one second contact portions, said first contact portion being electrically engageable with said conductive shell and said at least one second contact portion being electrically connectable to said first contact means of said at least one electrical component, said circuit means further including at least one third and at least one fourth contact portions, said at least one third contact portion being spaced from and paired with said at least one second contact portion and electrically connectable to said second contact means of said at least one electrical component and said at least one fourth contact portion extending from said at least one third contact portion and electrically engageable to said conductive panel.

4. The electrical coaxial connector assembly as described in claim 3 wherein said at least one lateral flange section further includes dielectric housing means having at least one respective component receiving aperture therein for receiving said at least one electrical component, said at least one second and said at least one third contact portions of said circuit means being exposed along the bottom surface of said aperture and electrically connected to respective first and second contact portions of said at least one electrical component.

5. The electrical coaxial connector assembly as described in claim 1 wherein said first dielectric member includes two laterally extending flange sections, each flange section providing a respective substrate to which at least one electrical component is mountable.

6. The electrical coaxial connector assembly as described in claim 5 having two electrical components mounted thereto, one on each of said two flange sections.

7. The electrical coaxial connector assembly as described in claim 5 wherein each of said two flanges has a plurality of electrical components mounted thereto.

8. An electrical coaxial connector assembly having filtered isolation means for isolating the connector from ground comprising:

a coaxial connector having a conductive inner contact and a conductive outer shell, said shell having first and second portions, said second portion extending outwardly from said first portion, said second portion including means for being mounted to a conductive panel member;

isolation means having first and second dielectric members cooperating with each other to provide a dielectric passageway through a cutout of a panel member to which the coaxial connector is to be mounted, each said dielectric member having an aperture extending therethrough for receiving said second portion of said conductive shell, said first and second dielectric members including bushing sections extending from surfaces proximate said panel member to engage and thereby form said passageway through said panel member cutout, said first and second dielectric members further including peripheral flanges to extend along major surfaces of said panel member about the periphery of said cutout;

said first dielectric member further including two laterally extending flange sections, each section providing a respective substrate to which at least one electrical component is mountable, conductive circuit means secured to a surface of said peripheral flange and said two lateral flange sections, said flange surface being remote from said panel member, said circuit means including a portion substantially surrounding said aperture and adapted to engage said conductive shell of said coaxial connector and establish an electrical connection therewith; and at least one electrical component mounted to said first dielectric member including at least a first contact means connected to said conductive circuit means and including a second contact means adapted to be electrically connected with said conductive panel member whereby said at least one electrical component completes an electrical circuit and provides filtering means between said conductive shell and said conductive panel member.

9. The electrical coaxial connector assembly as described in claim 8 wherein said at least one electrical component is selected from the group consisting of chip capacitors, resistors, unipolar diodes and bipolar diodes.

10. The electrical coaxial connector assembly as described in claim 8 wherein said conductive circuit means includes first and at least one second contact portions, said first contact portion being electrically engageable with said conductive shell and said at least one second contact portion being electrically connectable to said first contact means of said at least one electrical component, said circuit means further including at least one third and at least one fourth contact portions, said at least one third contact portion being spaced from and paired with said at least one second contact portion and electrically connectable to said second contact means of said at least one electrical component and said at least one fourth contact portion extending from said at least one third contact portion and electrically engageable to said conductive panel.

11. The electrical coaxial connector assembly as described in claim 10 wherein at least one of said lateral flange sections further includes dielectric housing means having at least one respective component receiving aperture therein for receiving said at least one electrical component, said at least one second and said at least one third contact portions of said circuit means being exposed along the bottom surface of said aperture and electrically connected to respective first and second contact portions of said at least one electrical component.

12. An electrical coaxial connector assembly having filtered isolation means for isolating the connector from ground comprising:

a coaxial connector having a conductive inner contact and a conductive outer shell, said shell having first and second portions, said second portion extending outwardly from said first portion, said second portion including means for being mounted to a conductive panel member;

isolation means having first and second dielectric members cooperating with each other to provide a dielectric passageway through a cutout of a panel member to which the coaxial connector is to be mounted, each said dielectric member having an aperture extending therethrough for receiving said second portion of said conductive shell, said first and second dielectric members including bushing sections extending from surfaces proximate said panel member to engage and thereby form said passageway through said panel member cutout, said first and second dielectric members further including peripheral flanges to extend along major surfaces of said panel member about the periphery of said cutout;

said first dielectric member further including two laterally extending flange sections, each section providing a respective substrate to which a plurality of electrical components are mountable, conductive circuit means secured to a surface of said peripheral flange and said two lateral flange sections, said flange surface being remote from said panel member, said circuit means including a portion substantially surrounding said aperture and adapted to engage said conductive shell of said coaxial connector and establish an electrical connection therewith; and a plurality of electrical components mounted to said first dielectric member, each component including at least a first contact means connected to said conductive circuit means and each component including a second contact means adapted to be electrically connected with said conductive panel member whereby each of said plurality of electrical components completes an electrical circuit and provides filtering means between said conductive shell and said conductive panel member.

13. The electrical coaxial connector assembly as described in claim 12 wherein said electrical components are selected from the group consisting of chip capacitors, resistors, unipolar diodes and bipolar diodes.

14. The electrical coaxial connector assembly as described in claim 12 wherein said conductive circuit means includes first and a plurality of second contact portions, said first contact portion being electrically engageable with said conductive shell and each of said plurality of second contact portions being electrically connectable to said first contact means of respective ones of said plurality of electrical components, said circuit means further including a plurality of third and fourth contact portions, each of said plurality of third contact portions being spaced from and paired with respective ones of said plurality of second contact portions and electrically connectable to said second contact means of respective ones of said plurality of electrical components and each of said plurality of fourth contact portions extending from respective ones of said plurality of third contact portions and electrically engageable to said conductive panel.

15. The electrical coaxial connector assembly as described in claim 14 wherein said lateral flange sections further include dielectric housing means having at least one respective component receiving aperture therein for receiving electrical components therein, respective pairs of said second and said third contact portions of said circuit means being exposed along the bottom surface of said aperture and electrically connected to respective first and second contact portions of said electrical components mounted therein.

16. The electrical coaxial connector assembly as described in claim 14 wherein said lateral flange sections further include dielectric housing means having a plurality of component receiving apertures therein for receiving respective electrical components therein, respective pairs of said second and said third contact portions of said circuit means being exposed along the bottom surface of respective ones of said apertures and electrically connected to respective first and second contact portions of said electrical components mounted therein.

17. A method for making an electrical coaxial connector assembly having filtered isolation means for isolating the connector from ground comprising the steps of:

selecting a coaxial connector having a conductive inner contact and a conductive outer shell, said shell having first and second portions, said second portion extending outwardly from said first portion, said second portion including means for being mounted to a conductive panel member;

providing isolation means having first and second dielectric members that cooperate with each other to form a dielectric passageway through a cutout of a panel member to which the coaxial connector is to be mounted, each said dielectric member having an aperture extending therethrough for receiving said second portion of said conductive shell, said first and second dielectric members including bushing sections extending from surfaces proximate said panel member to engage and thereby form said passageway through said panel member cutout, said first and second dielectric members further including peripheral flanges to extend along major surfaces of said panel member about the periphery of said cutout;

providing said first dielectric member with at least one laterally extending flange section including a respective substrate to which at least one electrical component is mountable, securing conductive circuit means to a surface of said peripheral flange and said at least one lateral flange section, said flange surface being remote from said panel member, said circuit means including a portion substantially surrounding said aperture and adapted to engage said conductive shell of said coaxial connector and establish an electrical connection therewith; and mounting at least one electrical component to said first dielectric member including at least a first contact means connected to said conductive circuit means and including a second contact means adapted to be electrically connected with said conductive panel member whereby said at least one electrical component completes an electrical circuit and provides filtering means between said conductive shell and said conductive panel member.

18. The method of making the electrical coaxial connector assembly as described in claim 17 wherein said at least one electrical component is selected from the group consisting of chip capacitors, resistors, unipolar diodes and bipolar diodes.

19. The method of making the electrical coaxial connector assembly as described in claim 17 wherein said conductive circuit means includes first and at least one second contact portions, said first contact portion being electrically engageable with said conductive shell and said at least one second contact portion being electrically connectable to said first contact means of said at least one electrical component, said circuit means further including at least one third and at least one fourth contact portions, said at least one third contact portion being spaced from and paired with said at least one second contact portion and electrically connectable to said second contact means of said at least one electrical component and said at least one fourth contact portion extending from said at least one third contact portion and electrically engageable to said conductive panel.

20. The method of making the electrical coaxial connector assembly as described in claim 19 further including the step of providing dielectric housing means on said at least one lateral flange section, said housing means including at least one respective component receiving aperture therein for receiving said at least one electrical component, said at least one second and said at least one third contact portions of said circuit means being exposed along the bottom surface of said aperture and electrically connected to respective first and second contact portions of said at least one electrical component.

* * * * *

UNITED STATES PATENT AND TRADEMARK OFFICE

CERTIFICATE OF CORRECTION

PATENT NO. : 4,797,120

DATED : January 10, 1989

INVENTOR(S) : Kirk David Ulery

It is certified that error appears in the above-identified patent and that said Letters Patent is hereby corrected as shown below:

Column 4, line 41, change "45" to --54--.

Column 4, line 61, change "Figure 4" to --Figure 4A--.

Column 4, line 68, change "contact means 82" to --contact means 98--.

Column 5, line 1, change "." to --,--.

Column 5, line 2, change "Figure 4A" to --Figure 4-- and "member 94" to --members 98--.

Column 5, line 3, change "member sections 40" to --member sections 42--.

Column 5, line 13, change "each cross member 82" to --each cross member 98--.

Column 5, line 26, change "at 28" to --at 48, as best seen in Figure 4--.

Column 6, line 2, change "Figure 7A" to --Figure 8A--.

In Figure 6, exchange reference numerals 65 and 66 with each other.

Signed and Sealed this

Twenty-second Day of August, 1989

*Attest:*

DONALD J. QUIGG

*Attesting Officer*

*Commissioner of Patents and Trademarks*